United States Patent [19]

Miller

[11] 4,338,740

[45] Jul. 13, 1982

[54] PISTOL SIGHT BASE BRIDGE

[76] Inventor: Fred R. Miller, 2620 E. 32nd St., Davenport, Iowa 52807

[21] Appl. No.: 182,908

[22] Filed: Sep. 2, 1980

[51] Int. Cl.[3] ..... F41G 1/02

[52] U.S. Cl. ..... 42/1 SR; 89/196

[58] Field of Search ..... 42/1 S, 1 SR, 1 ST; 89/163, 196

[56] References Cited

U.S. PATENT DOCUMENTS 2,744,448 5/1956 Allen ..... 89/196
4,021,954 5/1977 Crawford ..... 42/1 ST
4,127,056 11/1978 Kart ..... 89/196
4,192,075 3/1980 Strahan ..... 42/1 S

*Primary Examiner*—Stephen C. Bentley
*Attorney, Agent, or Firm*—Nathan Edelberg; Robert P. Gibson; Robert O. Richardson

[57] ABSTRACT

A sight base bridge for an automatic pistol having relative movement between its slide and barrel, said bridge permitting the mounting of sights directly to the pistol barrel, thus eliminating inaccuracy caused by tolerances between the barrel and slide formerly having the sights thereon. A similar mounting system can be used for attachment of silencers and compensators.

8 Claims, 8 Drawing Figures

PISTOL SIGHT BASE BRIDGE

GOVERNMENT RIGHTS

The invention described herein may be manufactured and/or used by or for the Government for governmental purposes without the payment of any royalty thereon.

BACKGROUND OF THE INVENTION

Most automatic pistols of current design share a common disadvantage from a targetshooters viewpoint. The sights are typically mounted on the slide which moves relative to the barrel with each shot fired. To facilitate this relative movement, there must be a certain amount of tolerance or clearance at the barrel/slide interface. As a result, the relationship of the barrel bore and the sights can change after each shot, thus decreasing the accuracy of the pistol.

Decreasing the amount of clearance at the barrel/-slide interface can significantly improve accuracy in many automatic pistols. For many applications this method of accurizing produces an acceptable target group. However, for target shooting, anything that can be done to further enhance accuracy is obviously to the advantage of the shooter.

The optimum condition exists when the sights are fixed directly to the barrel of the weapon, thereby eliminating any relative movement. This has been standard practice on revolver type handguns and rifles for years. However, the current design of automatic pistols, i.e., the barrel encased within the slide, does not easily lend itself to this concept of sight mounting.

In view of the foregoing it is an object of the present invention to provide means for rigidly mounting sights directly to the barrel of automatic pistols to enhance accuracy. Similar mounting means can be utilized for attachment of compensators and silencers.

SUMMARY OF THE PRESENT INVENTION

Typically, automatic pistols have a slide which moves longitudinally over the barrel. The slide normally has both front and rear sights mounted on it which, of course, also move relative to the barrel. A cartridge ejection port is typically situated in the slide between the front and rear sights. On many models of automatic pistols the ejection port is substantially enlarged to reduce the amount of recoiling mass. In addition, some automatics utilize a barrel which is longer than the slide, thus the barrel protrudes forwardly from the front end of the slide. On weapons of this type, the protruding front portion of the barrel and the area of the barrel exposed by the enlarged ejection port, can be utilized for mounting the sights directly to the barrel.

In accordance with the present invention, sight mounting spacers are affixed to the portion of the barrel exposed by the enlarged ejection port. These mounting spacers are positioned so as not to interfere with the recoil action of the slide. A commercially available sight bar or bridge can then easily be attached to the mounting spacers. In another embodiment the top forward portion of the slide can be cut away and the bridge mounted directly to the top of the barrel. Upon relative movement the bridge passes through the cut away portion of the slide. The back portion of the bridge has a raised under surface to clear the rear portion of the slide. As previously mentioned, many pistols utilize a barrel which protrudes past the front of the slide. On pistols of this type, a clamp arrangement can be utilized in conjunction with the spacer mounts to gain more support for the sight mounting or bridge mount. In addition, silencers and compensators can be easily mounted using the clamp arrangement of the present invention.

DETAILED DESCRIPTION OF ILLUSTRATIVE EMBODIMENTS

Figure 1:
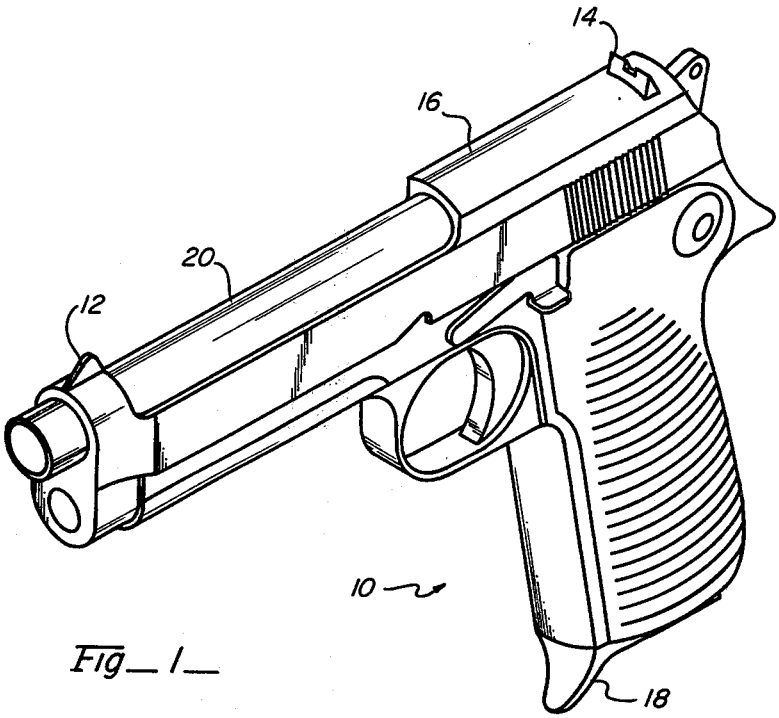
FIG. 1 is a perspective view of a typical automatic pistol.

Reference is made to FIG. 1 wherein there is shown a typical automatic pistol 10 having a front sight 12 and a rear sight 14. Both the front and the rear sights 12, 14 are mounted to the slide 16. In normal operation, the slide 16 recoils rearwardly after each shot. This recoil movement is necessary to eject the empty cartridge case from the chamber and to feed a fresh cartridge from the magazine 18 into firing position. During the initial ½ inch of recoil, the barrel 20 and slide 16 move together as a unit. At this point unlocking occurs. Locking mechanisms vary greatly in detail but are well known in the art and therefore will not be discussed here. After unlocking, the slide move independently of the barrel to accomplish the ejection and feeding functions as previously stated. The weapon action spring returns the slide to the battery position and locking occurs in the final increments of forward movement.

As can be seen from the foregoing explanation of the pistol function, the sights 12, 14 must move relative to the barrel each time the pistol is fired. It is therefore possible for the relationship of the barrel and the sights to change slightly after each shot. This change is due to the clearance between the slide 16 and the barrel 20 which is necessary for proper operation. Even though the clearances are held in a minimum, the change in the resultant point of impact can be substantial. A change of only one thousandth (0.001) of an inch between the barrel and the slide can cause a change of three tenths (0.3) of an inch in the point of impact at 50 yards. Since production tolerances at the barrel slide interface would undoubtedly exceed one thousandth (0.0001) of an inch the potential inaccuracy caused solely by this clearance could also be far greater than three tenths (0.3) of an inch.

Figure 2:
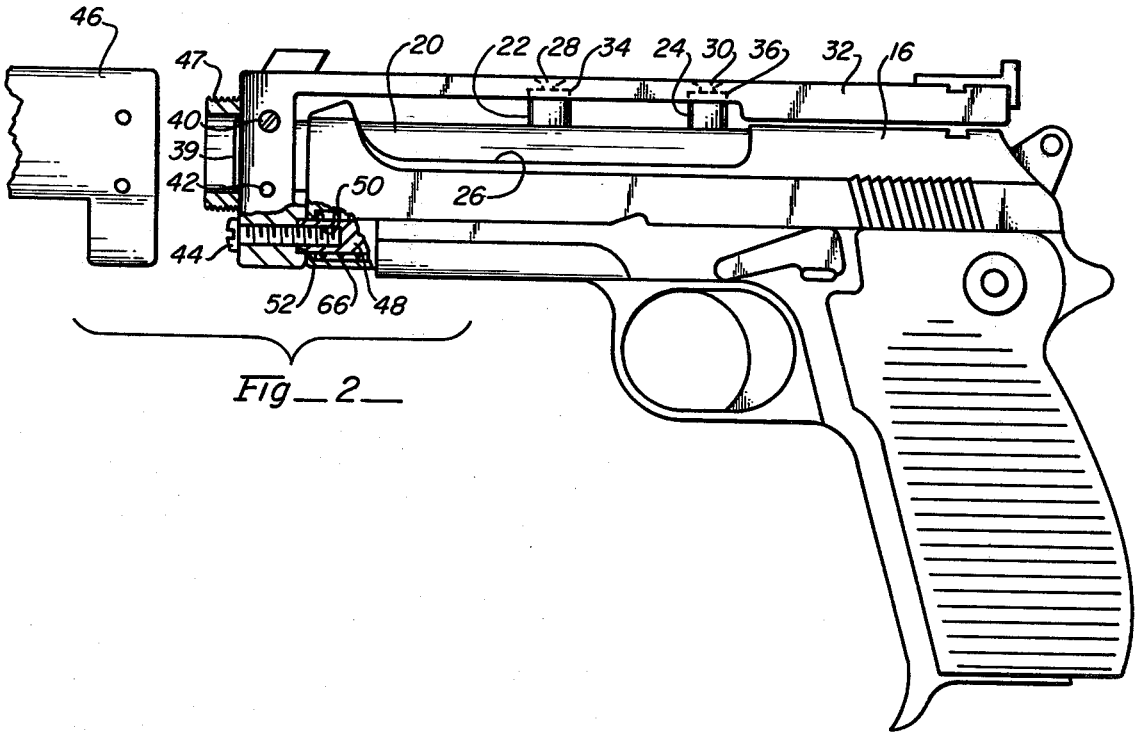
FIG. 2 is a side elevational view of the pistol in partial cross section showing a first embodiment of the sight attachment.

Reference is now made to FIG. 2 wherein a first embodiment of a sight base bridge in accordance with the present invention is shown. The bridge allows the sights to be attached directly to the barrel thus eliminating any sighting errors caused by the changing relationship of the sights and the barrel. As shown in FIG. 2 posts 22, 24 may be attached to the barrel 20 where it is exposed by the ejection opening 26 in the slide 16. The posts 22, 24 can be attached by any convenient means such as silver soldering or they can be made as an integral part of the barrel 20. The posts 22, 24 are positioned so as not to interfere with the recoil action of the slide 16 and are drilled and tapped to receive screws 28, 30 which retain the bridge 32. Note: the standard rear sight 14 must be removed to accomodate the bridge. The sight bar 32 has recesses 34, 36 in its underside for receiving the posts 22, 24. This assures a firm mount which will not shift when subjected to the impulse of firing.

Figure 3:
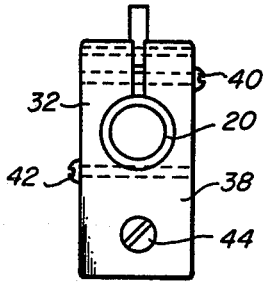
FIG. 3 is a front view of the first embodiment of the sight attachment.

The foremost portion 38 of the bridge 32 utilizes screws 40, 42 (see FIG. 3) to achieve a clamping effect on the muzzel end 39 of the barrel 20. As shown in FIG. 3, tightening screw 40 squeezes or clamps the bridge 32 tightly around the barrel 20. Screw 42 engages the underside of the barrel 20 to prevent rotation of the bridge 32. Screw 44 is used to further secure the bridge 32 against rotation. A slight modification to the pistol is necessary to install screw 44. The action spring guide rod 48 (see FIG. 2 & 4) is drilled and tapped as at 50 to accept screw 44. The screw 44 may then be inserted through the front of the bridge 32 and tightened. Tightening the screw 44 draws the guide rod forwardly into a recess 52 in the sight bar 32. Auxiliary devices 46 such as compensators or silencers can be mounted in a similar fashion. These auxiliary devices 46 may be used in conjunction with the sight bridge 32 or can be installed with the bridge 32 removed. When used without the bridge 32 the auxiliary devices are attached to the muzzel end of the weapon in a manner similar to the sight bridge 32 using clamping screws 40, 42 and guide rod screw 44. Alternately, the auxiliary devices 46 may be attached to the threaded cylinder 47 on the foremost end of the bridge 32 while the bridge is installed on the pistol. Here the auxiliary device is simply screwed over the threaded cylinder 47 and is secured against rotation by the guide rod screw 44.

Figure 4:
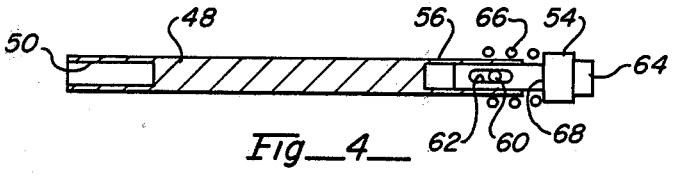
FIG. 4 is a cross sectional view of the modified spring guide used with the first embodiment of the sight mount.

When using the guide rod screw 44 for mounting the bridge or auxiliary devices, provisions must also be made to allow the guide rod 48 to reciprocate. Since the guide rod 48 is connected to the barrel 20 when using this mounting method, and the barrel 20 reciprocates during unlocking and locking, the guide rod 48 must also reciprocate. This differs from the normal pistol operation, where the guide rod remains stationary during firing. To accomodate the reciprocating movement of the guide rod 48 a sliding plunger 54 is provided at the rear end 56 of the guide rod 48 as shown in FIG. 4. The standard guide rod configuration is much the same, however, the plunger is made as an integral part of the rod (not shown). The plunger 54 fits within bore 58 in the end 56 of the guide rod 48. A pin 60 engages a slot 62 in the plunger 54 to retain it while permitting a sliding motion between the rod 48 and plunger 54. When assembled to the pistol 10 the rearmost tip 64 of the plunger 54 engages an aperture (not shown) in the pistol frame. The action spring 66, is compressed between a shoulder 68 on the plunger 54 and the slide 16. This urges the slide 16 forwardly while maintaining engagement of tip 64 with its corresponding aperture in the weapon frame. This arrangement allows the guide rod 48 to reciprocate as necessary while assuring engagement of the plunger tip 64 in its associated aperture, which is necessary for proper operation.

Figure 5:
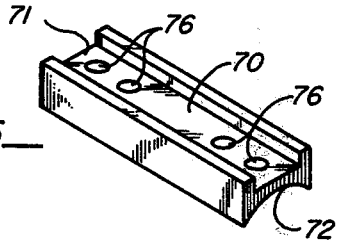
FIG. 5 is a perspective view of a sight base bridge used with the second embodiment of sight attachment.
Figure 6:
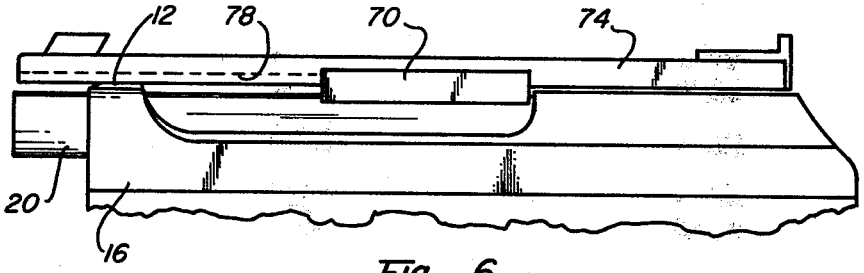
FIG. 6 is a partial side elevational view of the pistol showing the second embodiment of the sight base bridge installed on the weapon.

Reference is now made to FIG. 5 wherein a second embodiment of a spacer means 70 for bridge 74 is shown. This embodiment utilizes an elongated channel 71 which cradles the bridge. FIG. 6 shows this type of bridge installed on a pistol. As shown, the spacer 70 has an arcuate lower surface 72 adapted for attachment to the barrel 20 of the pistol. As with the posts 22, 24 of the previously described embodiment, the elongated spacer 70 may be attached by silver soldering or can be manufactured as an integral part of the barrel 20 in a manner which will not restrict recoil movement of the slide. In this embodiment the clamp arrangement is not used. Therefore, modification of the action spring guide rod 48 is not necessary. Four screws (not shown) are utilized to attach the bridge 74 to base 70. The four screws pass through the bridge and engage threaded apertures 76 in the sight base 70. A relief slot 78 is cut into the underside of the bridge to accomodate movement of the standard front sight 12 on slide 16.

Figure 7:
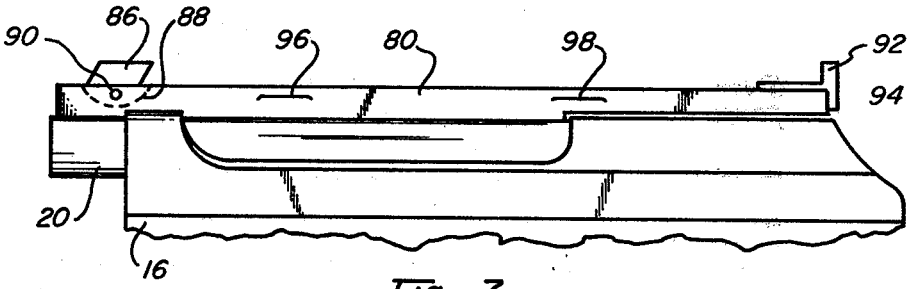
FIG. 7 is a partial side elevational view similar to FIG. 6 but showing a third embodiment of the sight attachment.
Figure 8:
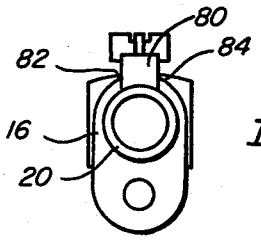
FIG. 8 is a front view of the embodiment shown in FIG. 7.

FIGS. 7 and 8 illustrate a third embodiment of the present invention. The bridge 80 is attached directly to the barrel 20 in this embodiment. This method of attaching the bridge 80 requires machining away a portion of the slide 16 in the area of the standard front sight 12 to accomodate the bridge 80. The sides 82, 84 of the bridge then act as bearing surfaces for the slide 16 during its recoil movement.

It should be noted that the use of a bridge permits the use of target type sights with any of the previously described embodiments. These sights are attached in the conventional fashion. As shown in FIG. 7, the front sight blade 86 is inserted into a crescent shaped slot 88 in the bridge 80 and retained with a pin 90. The rear sight 92 is driven into a dove tail slot 94 as is the standard rear sight 14. A scope (not shown) could also be mounted to the bridge 80 in the conventional fashion by utilizing mounting slots 96, 98. The use of these types of sights offers an additional improvement in accuracy. Therefore, the combination of mounting the sights directly to the barrel and the use of target sights can provide a significant improvement in accuracy over an unmodified pistol.

The invention in its broader aspects is not limited to the specific combinations, improvements and instrumentalities described but departures may be made therefrom within the scope of the accompanying claims without departing from the principles of the invention and without sacrificing its chief advantages.

I claim:

1. In combination with a pistol having a slide and barrel having relative movement therebetween.

said barrel having a bridge thereon, said slide having a cartridge ejection port thereon, said bridge being attached to said barrel through said ejection port to avoid slide contact with said bridge when relative movement occurs, and sight means on said bridge, said bridge having a relief cut in its underneath surface to ride over the front sight of said pistol on said slide.

2. The combination as set forth in claim 1 wherein spacer means is mounted on said barrel, said spacer means having an arcuate undersurface to mate with the curvature of said barrel, said spacer means having upstanding side ribs to cradle said bridge therebetween.

3. The combination as set forth in claim 1 wherein spacer means is mounted on said barrel, said spacer means comprising a pair of upstanding posts attached to said barrel, said bridge having recesses in its undersurface to receive said posts.

4. The combination as set forth in claim 1 including clamp means on said bridge for clamping said barrel forwardly of said slide.

5. The combination as set forth in claim 4 wherein said clamp means has an attachment means for mounting an auxiliary device forwardly of said pistol barrel.

6. The combination as set forth in claim 4 wherein said pistol has an action spring for returning said slide to battery position, a guide rod within said spring, means attaching said bridge to said guide rod, said guide rod being longitudinally extendable and compressible to accomodate longitudinal movement of said barrel.

7. The combination as set forth in claim 6 wherein said clamp means has an attachment means for mounting an auxiliary device forwardly of said pistol barrel and said means attaching said bridge to said guide rod also attaches said auxilliary device to said guide rod.

8. In combination with a pistol having a slide and barrel having relative movement therebetween, an action spring for returning said slide to battery position, and a guide rod within said spring, clamp means for attachment to said barrel forwardly of said slide, attachment means on said clamp means for mounting an auxiliary device forwardly of said pistol barrel, and means attaching said clamping means and said auxiliary device to said guide rod, said guide rod being longitudinally extendable and compressible to accomodate longitudinal movement of said barrel.

* * * * *